US008151886B2

(12) United States Patent
Xu et al.

(10) Patent No.: US 8,151,886 B2
(45) Date of Patent: Apr. 10, 2012

(54) OPEN HOLE STIMULATION WITH JET TOOL

(75) Inventors: Yang Xu, Houston, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 215 days.

(21) Appl. No.: 12/618,032

(22) Filed: Nov. 13, 2009

(65) Prior Publication Data

US 2011/0114319 A1 May 19, 2011

(51) Int. Cl.
*E21B 43/00* (2006.01)

(52) U.S. Cl. ..... 166/308.1; 166/223

(58) Field of Classification Search ..... 166/308.1, 166/223, 318, 332.4
See application file for complete search history.

(56) References Cited

U.S. PATENT DOCUMENTS

| | | | | |
|---|---|---|---|---|
| 4,475,729 | A | 10/1984 | Costigan | |
| 5,111,881 | A | 5/1992 | Soliman et al. | |
| 5,335,724 | A | 8/1994 | Venditto et al. | |
| 5,355,802 | A | 10/1994 | Petitjean | |
| 5,363,927 | A * | 11/1994 | Frank | 175/67 |
| 5,494,103 | A * | 2/1996 | Surjaatmadja et al. | 166/222 |
| 5,551,344 | A | 9/1996 | Couet et al. | |
| 5,765,642 | A | 6/1998 | Surjaatmadja | |
| 6,394,184 | B2 | 5/2002 | Tolman | |
| 6,520,255 | B2 | 2/2003 | Tolman | |
| 6,543,538 | B2 | 4/2003 | Tolman | |
| 6,575,247 | B2 | 6/2003 | Tolman | |
| 6,672,405 | B2 | 1/2004 | Tolman | |
| 6,957,701 | B2 | 10/2005 | Tolman | |
| 7,059,407 | B2 | 6/2006 | Tolman | |
| 7,159,660 | B2 | 1/2007 | Justus | |
| 7,267,172 | B2 | 9/2007 | Hofman | |
| 7,287,592 | B2 | 10/2007 | Sujaatmadja et al. | |
| 7,387,158 | B2 | 6/2008 | Murray | |
| 7,387,165 | B2 | 6/2008 | Lopez de Cardenas | |
| 7,392,841 | B2 | 7/2008 | Murray | |
| 7,422,058 | B2 | 9/2008 | O'Malley | |
| 7,431,090 | B2 | 10/2008 | Sujaatmadja et al. | |
| 7,441,596 | B2 | 10/2008 | Wood | |
| 7,571,766 | B2 | 8/2009 | Pauls et al. | |
| 7,617,871 | B2 * | 11/2009 | Surjaatmadja et al. | 166/298 |
| 2006/0070739 | A1 | 4/2006 | Brooks et al. | |
| 2006/0201675 | A1 | 9/2006 | Ferguson | |
| 2008/0121390 | A1 | 5/2008 | O'Malley | |
| 2009/0266548 | A1 * | 10/2009 | Olsen et al. | 166/308.1 |

OTHER PUBLICATIONS

U.S. Appl. No. 12/463,944, filed May 11, 2009 entitled "Fracturing with Telescoping Members and Sealing the Annular Space".

L. East, et al "Packerless Multistage Fracture Stimulation Method Using CT Perforating and Annular Path Pumping" SPE 96732 (2005).

* cited by examiner

*Primary Examiner* — William P Neuder
(74) *Attorney, Agent, or Firm* — Steve Rosenblatt

(57) ABSTRACT

A fracturing method for preferably open hole uses fluid velocity impinging on the wellbore wall to initiate fractures. Telescoping members that extend using nozzles inside them but come out to a distance from the wellbore wall can be used. Fixed nozzles that do not extend are also another option. The nozzles can be eroded or corroded as the fracturing takes place or they can be made of sufficiently durable materials or have coatings to withstand the erosive effects of high velocity slurries pumped to impinge the wellbore wall to initiate fractures.

14 Claims, 2 Drawing Sheets

OPEN HOLE STIMULATION WITH JET TOOL

FIELD OF THE INVENTION

The field of the invention is fracturing and more particularly a method for fracturing in open hole using impinging force on the formation.

BACKGROUND OF THE INVENTION

There are two commonly used techniques to fracture in a completion method. FIG. 1 shows a borehole 10 that has a casing string 12 that is cemented 14 in the surrounding annulus 16. This is normally done through a cementing shoe (not shown) at the lower end of the casing string 12. In many cases if further drilling is contemplated, the shoe is milled out and further drilling progresses. After the string 12 is cemented and the cement 14 sets a perforating gun (not shown) is run in and fired to make perforations 18 that are then fractured with fluid delivered from the surface followed by installation and setting of packer or bridge plug 20 to isolate perforations 18. After that the process is repeated where the gun perforates followed by fracturing and followed by setting yet another packer or bridge plug above the recently made and fractured perforations. In sequence, perforation and packer/bridge plug pairs 22, 24; 26, 28; 30, 32; and 34 are put in place in the well 10 working from the bottom 36 toward the well surface 38.

A variation of this scheme is to eliminate the perforation by putting into the casing wall telescoping members that can be selectively extended through the cement before the cement sets to create passages into the formation and to bridge the cemented annulus. The use of extendable members to replace the perforation process is illustrated in U.S. Pat. No. 4,475,729. Once the members are extended, the annulus is cemented and the filtered passages are opened through the extending members so that in this particular case the well can be used in injection service. While the perforating is eliminated with the extendable members the cost of a cementing job plus rig time can be very high and in some locations the logistical complications of the well site can add to the cost.

More recently, external packers that swell in well fluids or that otherwise can be set such as 40, 42, 44, 46, and 48 in FIG. 2 can be set on the exterior of the string 49 to isolate zones 50, 52, 54, and 56 where there is a valve, typically a sliding sleeve 58, 60, 62 and 64 in the respective zones. The string 49 is capped at its lower end 67. Using a variety of known devices for shifting the sleeves, they can be opened in any desired order so that the annular spaces 68, 70, 72 and 74 can be isolated between two packers so that pressurized frac fluid can be delivered into the annular space and still direct pressure into the surrounding formation. This method of fracturing involves proper packer placement when making up the string and delays to allow the packers to swell to isolate the zones. There are also potential uncertainties as to whether all the packers have attained a seal so that the developed pressure in the string is reliably going to the intended zone with the pressure delivered into the string 49 at the surface. Some examples of swelling packer are U.S. Pat. Nos. 7,441,596; 7,392,841 and 7,387,158.

In some instances the telescoping members have been combined with surrounding sleeves of a swelling material to better seal the extended ends of the telescoping members to the formation while still leaving open the remainder of the annular space to the formation in a given zone. Some examples of this design are U.S. Pat. Nos. 7,387,165 and 7,422,058. US Publication 2008/0121390 shows a spiral projection that can swell and/or be expanded into wellbore contact and leave passageways in between the projections for delivery of cement.

U.S. application Ser. No. 12/463,944 filed May 11, 2009 and entitled Fracturing with Telescoping Members and Sealing the Annular Space shows a technique to pinpoint the applied frac pressure to the desired formation while dispensing with expensive procedures such as cementing and annulus packers where the formation characteristics are such as that the hole will retain its integrity. The pressure in the string is delivered through extendable conduits that go into the formation. Given banks of conduits are coupled with an isolation device so that only the bank or banks in interest that are to be fractured at any given time are selectively open. The delivered pressure through the extended conduits goes right to the formation and bypasses the annular space in between. Beyond that the string exterior can have a covering of a swelling material such as rubber or a shape memory polymer, either of which can fill the annular gap and replace the traditional and expensive cement job.

Also relevant are: US Publication 2006/0201675; U.S. Pat. Nos. 7,059,407; 6,957,701; 6,672,405; 6,575,247; 6,543,538; 6,520,255; 6,394,184; 5,765,642; L. East, Packerless Multistage Fracture Stimulation Method Using CT Perforating and Annular Path Pumping SPE 96732 (2005)

The present invention goes in the opposite direction of the application entitled Fracturing with Telescoping Members and Sealing the Annular Space in that it deliberately leaves a gap to the formation such as in open hole so that there is a jetting action of velocity effects on the borehole wall which starts the fractures. Rather than bridging an annular gap from the string to the borehole wall whether with fixed or movable nozzles the present invention directs fluid velocity at the borehole wall to accomplish the fracturing.

Those and other features of the present invention will be more readily understood to those skilled in the art from a review of the description of the preferred embodiment and the associated drawings that are not labeled prior art while understanding that the full scope of the invention is determined by the literal and equivalent scope of the appended claims.

SUMMARY OF THE INVENTION

A fracturing method for preferably open hole uses fluid velocity impinging on the wellbore wall to initiate fractures. Telescoping members that extend using nozzles inside them but come out to a distance from the wellbore wall can be used. Fixed nozzles that do not extend are also another option. Either way the openings or nozzles are on a string supported in open hole from a cased wellbore as part of a completion. The nozzles can be eroded or corroded as the fracturing takes place or they can be made of sufficiently durable materials or have coatings to withstand the erosive effects of high velocity slurries pumped to impinge the wellbore wall to initiate fractures.

DETAILED DESCRIPTION OF THE PREFERRED EMBODIMENT

Figure 1:
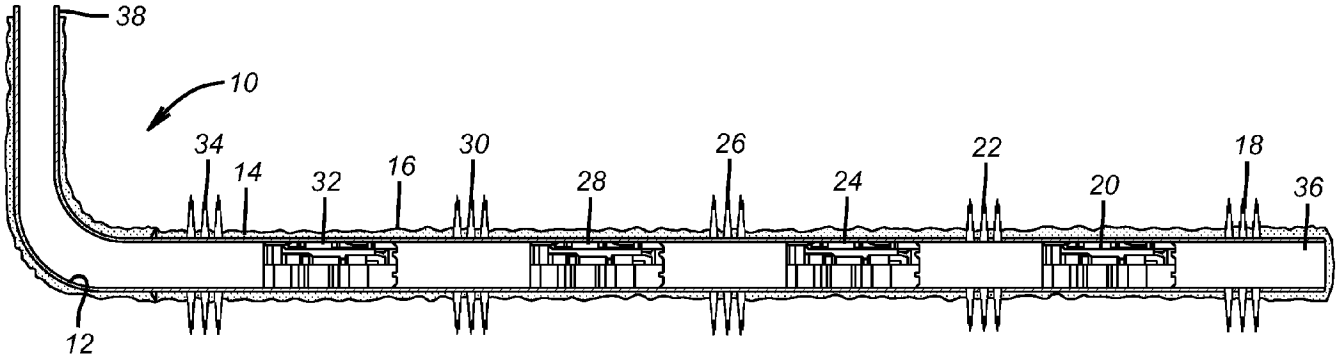
(PRIOR ART) FIG. 1
FIG. 1 is a prior art perforating and plug system for cemented casing.
Figure 2:
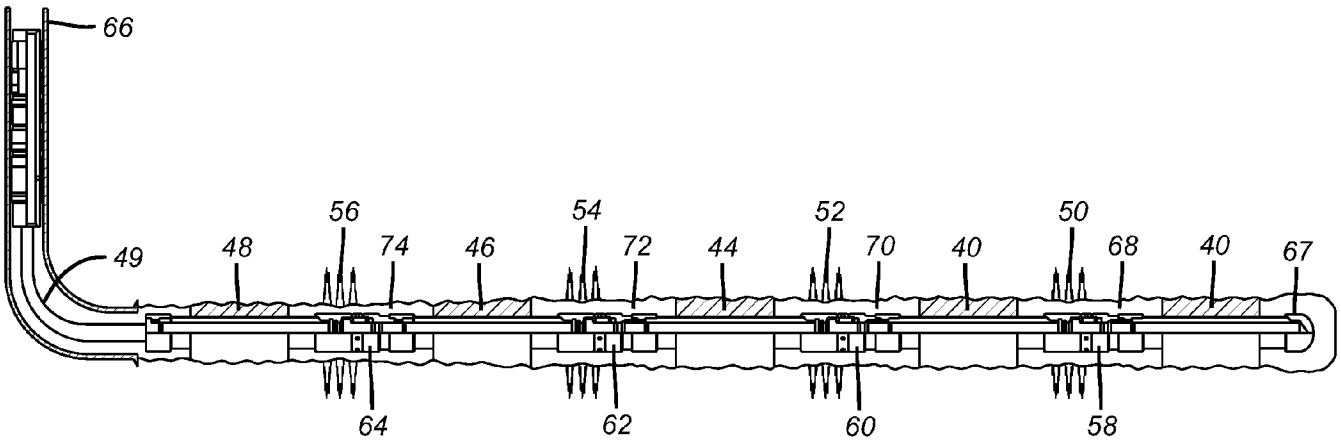
(PRIOR ART) FIG. 2
FIG. 2 is a prior art open hole completion with annular seals.
Figure 4:
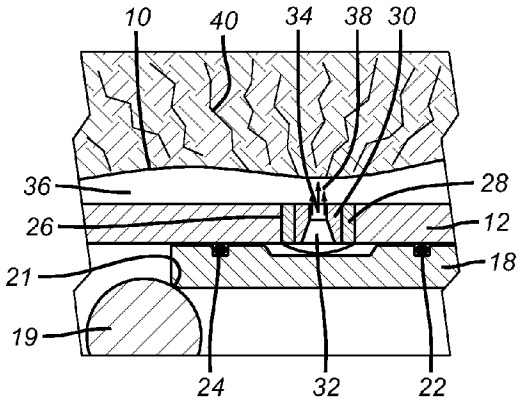
FIG. 4 shows a nozzle behind a sliding sleeve for access to the open hole wall for fracturing.
Figure 3:
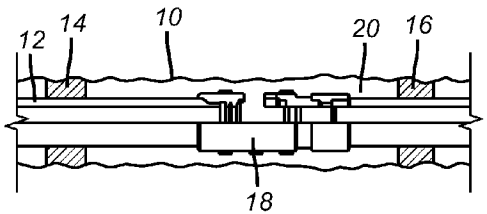
FIG. 3 illustrates a zone isolated with packers and a sliding sleeve to provide access for fracturing the zone.

FIG. 3 shows an open hole 10 with a tubular string 12 and spaced packers 14 and 16. Access to the zone 20 is through a sliding sleeve 18 although other ways to gain access are also contemplated. FIG. 4 shows a closer view of the sliding sleeve 18 showing seals 22 and 24 straddling opening 26 to close it off. The sliding sleeves 18 are opened in a desired order by dropping balls 19 on ball seats 21 associated with each sleeve 18 to shift the sleeve 18 between the closed and open position in the desired sequence. More than one sleeve can be used in association with multiple openings where one sleeve is actuated to provide access to a group of openings and another sleeve can be used to cover such openings. Successive balls that are dropped can isolate zones below that are already fractured. Opening 26 has a nozzle housing 28 within which is a nozzle assembly 30 that comprises of an inlet taper 32 leading to a cylindrically shaped exit passage 34. A gap 36 exists to the formation at the borehole wall 10. A fluid stream 38 comes out at high velocity to impinge the borehole wall 10 and to initiate the fractures 40. The fracture fluid can have some solids and the high velocities can over the duration of the fracturing erode or corrode out taper 32 and/or exit passage 34. While that is tolerable the main point is to initially impinge on the borehole wall from a distance where tests have shown that having the distance results in bigger and deeper fractures and more of them than prior techniques where it was believed that the optimal fracturing occurs when the telescoping members have outlets right at or into the borehole wall 10. As it turns out the spacing from the borehole wall 10 of the end of the nozzle housing 36 yields the unexpected better fracture job on the surrounding formation.

Figure 7:
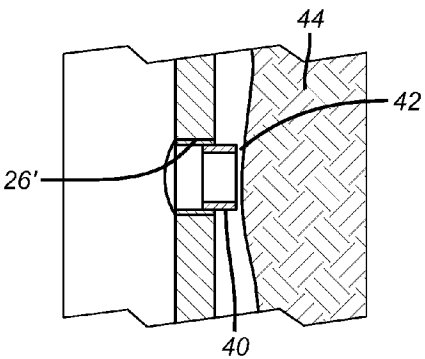
FIG. 7 illustrates the nozzle eroded or corroded away from the telescoping member that has extended to a location spaced apart from the borehole wall.
Figure 6:
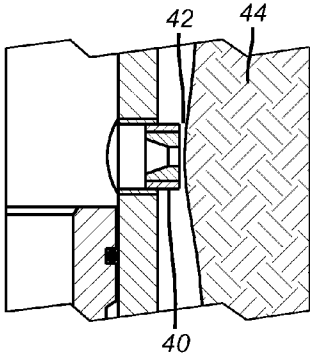
FIG. 6 is the view of FIG. 5 showing the nozzle extended to a distance spaced apart from the borehole wall.
Figure 5:
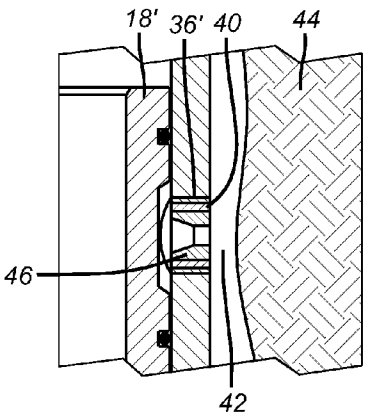
FIG. 5 shows a run in position of a telescoping nozzle.

FIG. 5 shows an alternative embodiment which has the same housing 36' as in FIG. 4 but in this case there is a telescoping member 40 that travels out radially until it hits a travel stop that is not shown so that in the fully extended position it still leaves a gap 42 to the formation 44. A nozzle 46 as previously described for the FIG. 4 embodiment is also used in FIGS. 5-7 to urge the nozzle 46 to extend to make the gap 42 smaller than in the run in position of FIG. 5. The flow through the nozzle 46 drives it to the travel stop and also can serve to erode or corrode it away to let the flow volumes increase as the fracturing progresses as parts of the nozzle 46 erodes or corrodes away and the pressure drop across it decreases. Initially and during the fracturing, the velocity increase aids in increasing the impingement force onto the formation to initiate the fractures. As the nozzle 46 erodes or corrodes the flow volume increases while the impact force can decrease as the nozzle 46 wears away. Alternatively, the material for the nozzle can be such that there is minimal or no nozzle erosion or corrosion and the fluid impact velocity remains as the fractures propagate. As before the sliding sleeve 18' can be closed with a shifting tool or another dropped ball that can be positioned over the opening 26' to close it off. This process can be repeated for multiple isolated portions of a wellbore in open hole using a sequence of dropped balls or straddle tools that provides access to a desired segment and its associated nozzles at a given time. The use of a straddle tool would eliminate the need for isolation valves for fracturing however the presence of such valves allows flexibility to isolate zones when they are not to be produced or it they produce too much water or sand, for example.

Openings with nozzles can be used without the telescoping members to narrow the gap to the open hole wellbore wall as an alternative to the assemblies of the telescoping members with nozzles in them. Making the gap to the formation smaller increases the force applied to the formation for enhanced fracturing. It should be noted that the method of the present invention contemplates a string fixedly suspended in open hole for fracturing from a cased hole above using a support such as a liner hanger.

The above description is illustrative of the preferred embodiment and various alternatives and is not intended to embody the broadest scope of the invention, which is determined from the claims appended below, and properly given their full scope literally and equivalently.

We claim:

1. A completion method for fracturing in open hole below a cased hole, comprising:

fixedly supporting a string from the cased hole, said string having at least one opening adjacent a desired location in open hole;

impinging the formation at said desired location with fluid pumped through said opening; fracturing said formation with said impinging providing a telescoping member at said opening;

actuating said telescoping member at the desired location to move closer to the formation while still leaving a gap.

2. The method of claim 1, comprising:

selectively opening a valve that covers said opening.

3. The method of claim 1, comprising:

providing at least one seal outside said string for isolation of said desired location when fracturing.

4. The method of claim 1, comprising:

providing a nozzle in said opening having an outlet defining a gap to the formation; increasing velocity of pumped fluid using said nozzle.

5. The method of claim 1, comprising:

providing a nozzle in said telescoping member;

using pumped flow through said nozzle to extend said telescoping member.

6. The method of claim 5, comprising:

using pumped fluid to erode or corrode said nozzle after said telescoping member is extended.

7. The method of claim 1, comprising:

using a plurality of openings as said at least one opening;

providing sequential access to groups of said openings using a plurality of valves.

8. The method of claim 7, comprising:

using a plurality of external isolators on said string to define sequential isolation locations for fracturing through groups of said openings.

9. The method of claim 7, comprising:

associating seats of different sizes with said plurality of valves;

introducing objects sequentially onto said seats to at least open said valves.

10. The method of claim 7, comprising:

providing nozzles in said openings;

increasing velocity of pumped fluid using said nozzles.

11. The method of claim 7, comprising:

providing telescoping members at said openings;

actuating said telescoping members to move closer to the formation while still leaving gaps.

12. The method of claim 11, comprising:

providing a nozzle in said telescoping member;

using pumped flow through said nozzle to extend said telescoping member.

13. The method of claim 12, comprising:

using pumped fluid to erode or corrode said nozzle after said telescoping member is extended.

14. A completion method for fracturing in open hole below a cased hole, comprising:

fixedly supporting a string from the cased hole, said string having at least one opening adjacent a desired location in open hole;

impinging the formation at said desired location with fluid pumped through said opening;

fracturing said formation with said impinging;

using a plurality of openings as said at least one opening;

providing sequential access to groups of said openings using a plurality of valves;

associating seats of different sizes with said plurality of valves;

introducing objects sequentially onto said seats to at least open said valves;

using said objects to isolate locations already fractured.

* * * * *